US005961292A

United States Patent [19]

Shui et al.

[11] Patent Number: 5,961,292

[45] Date of Patent: Oct. 5, 1999

[54] RIPPLE-EFFECT REMOVING VALVE FOR USE WITH A PRESSURE DETECTING DEVICE IN A CONTROL ASSEMBLY OF A PUMP

[76] Inventors: Tsao-Shang Shui, No. 321, Min-Chu Rd., Tung Dist.; De-Chang Wu, No. 114, Tai-Lin St., Tung Dist., both of Chia-Yi City, Taiwan

[21] Appl. No.: 08/939,343

[22] Filed: Sep. 29, 1997

[51] Int. Cl.[6] ..... F04B 49/06

[52] U.S. Cl. ..... 417/44.1; 417/44.9

[58] Field of Search ..... 417/44.1, 44.9; 261/DIG. 38

[56] References Cited

U.S. PATENT DOCUMENTS

| | | | |
|---|---|---|---|
| 3,119,551 | 1/1964 | Beeman | 230/31 |
| 3,166,292 | 1/1965 | Forman | 251/215 |
| 3,283,094 | 11/1966 | Lung | 200/81.9 |
| 4,568,499 | 2/1986 | Wood | 261/41 D |
| 5,002,705 | 3/1991 | Kohler | 261/35 |
| 5,441,673 | 8/1995 | Gerhardy | 261/34.1 |
| 5,772,927 | 6/1998 | Koizumi et al. | 261/67 |

*Primary Examiner*—Timothy S. Thorpe
*Assistant Examiner*—Ehud Gartenberg
*Attorney, Agent, or Firm*—Fish & Richardson P.C.

[57] ABSTRACT

A control assembly for a pump includes a ripple-effect removing valve and a pressure detecting device. The ripple-effect removing valve includes a casing having a lower inlet end in fluid communication with a hollow body of the pump, an upper outlet end and an interior fluid passage which fluidly communicates the inlet and outlet ends and which includes a generally upright lower section with a top opening, a generally upright upper section with a bottom opening, and a substantially horizontal intermediate section fluidly communicating the upper and lower sections. The valve further includes a regulator for controlling fluid flow from the lower section to the upper section. The pressure detecting device is fluidly communicated with the upper outlet end of the casing, and deactivates an impeller unit of the pump when the pressure of the fluid entering the pressure detecting device via the fluid passage of the casing reaches a predetermined value.

10 Claims, 6 Drawing Sheets

RIPPLE-EFFECT REMOVING VALVE FOR USE WITH A PRESSURE DETECTING DEVICE IN A CONTROL ASSEMBLY OF A PUMP

BACKGROUND OF THE INVENTION

1. Field of the Invention

The present invention relates to a pump with a control assembly for controlling activation and deactivation of an impeller unit of the pump, more particularly to one which has a control assembly that incorporates a ripple-effect removing valve so as to correctly deactivate the impeller unit upon detecting that the pressure of fluid at an outlet of the pump reaches a predetermined value.

2. Description of the Related Art

FIGS. 1 and 2 illustrate a conventional rotary pressurizing pump 1 with a pressure detecting device 3 mounted thereon for controlling activation and deactivation of a rotary impeller unit 15 of the pump 1. The rotary pressurizing pump 1 includes a hollow body 11 having an inlet 13 and an outlet 12 which is formed in an upper portion of the hollow body 11. The impeller unit 15 is disposed in the hollow body 11 for increasing pressure of fluid that flows from the inlet 13 to the outlet 12. The hollow body 11 is further formed with a threaded mounting hole 14 in the upper portion and adjacent to the outlet 12. The fluid pressure at the mounting hole 14 is substantially equal to the fluid pressure at the outlet 12. The pressure detecting device 3 is mounted on the hollow body 11 at the mounting hole 14 for detecting the fluid pressure at the outlet 12. As shown, a non-return valve 2 is mounted on the hollow body 11 at the inlet 13 to permit fluid flow in a direction toward the inlet 13 while preventing fluid flow in an opposite direction out of the inlet 13.

The pressure detecting device 3 includes a housing 36 having a lower threaded end 311 mounted threadedly in the threaded mounting hole 14 of the hollow body 11. A switch assembly 34, which is connected electrically to the impeller unit 15 of the pump 1, is provided in the housing 36. The housing 36 has a lower chamber 38 which is fluidly communicated with the mounting hole 14 to permit the flow of fluid from the mounting hole 14 to the lower chamber 38 in an upward direction. A diaphragm unit 32 is supported on a diaphragm seat 321 and is disposed horizontally in the lower chamber 38. The diaphragm unit 32 senses the pressure of the fluid entering the lower chamber 38 and bulges accordingly due to the pressure of the fluid. An actuator 331 is mounted on the diaphragm unit 32 and is operably connected to the switch assembly 34, which includes a horizontal linking plate 342, a curved spring plate 344, an upright linking rod 345, a spring-loaded switch member 346 and an electrical contact 35. In detail, the actuator 331 has an upper end abutting against a portion of the horizontal linking plate 342, which has one end connected to a first end of the curved spring plate 344. The spring plate 344 has a second end connected to the upright linking rod 345 which, in turn, is connected to a lower end of the spring-loaded switch member 346. The switch member 346 is normally biased upwardly to contact the electrical contact 35 so as to establish electrical connection between the switch assembly 34 and the impeller unit 15 of the pump 1. The pressure detecting device 3 further includes a biasing spring 336 mounted on a support 333 and disposed in the housing 36 above the horizontal linking plate 342. A movable pressing board 335 is disposed on the biasing spring 336, and a regulating screw member 334 is mounted on the pressing board 335. The regulating screw member 334 is operable to move the pressing board 335 downwardly to compress the biasing spring 336 or upwardly to relax the biasing spring 336 so as to preset the biasing force of the latter. The biasing spring 336 has a lower end provided with an abutment member 332 that abuts against the horizontal linking plate 342 due to the biasing force of the spring 336. Therefore, the biasing force of the spring 336 can be preset for pushing the diaphragm unit 32 to resist bulging thereof until the pressure of the fluid reaches the predetermined value.

Referring to FIG. 3, once the pressure of the fluid entering the lower chamber 38 reaches the predetermined value, the diaphragm unit 32 bulges upwardly to move the actuator 331 and the horizontal linking plate 342 upwardly against the biasing force of the spring 336. At this time, the curved spring plate 344 moves to pull the upright linking rod 345 and the spring-loaded switch member 346 downwardly so that the switch member 346 is not in contact with the electrical contact 35 and so that the electrical connection between the switch assembly 34 and the impeller unit 15 is broken. The impeller unit 15 is deactivated to stop pressurizing of the fluid at this time. Therefore, the pressure of fluid will not be excessive so as to avoid damaging the pump.

The pressure detecting device 3 achieves the purpose of automatically turning-off the impeller unit 15 of the pump 1 upon detecting that the pressure of fluid at the outlet 12 reaches a predetermined value. It is noted that incorrect action of the diaphragm unit 32 usually occurs due to the ripple-effect of the fluid entering into the lower chamber 38. That is to say, undesired bulging of the diaphragm unit 32 might occur due to the ripple-effect of the fluid, thereby deactivating the impeller unit 15 before the pressure of the fluid reaches the predetermined value. It is thus desired to provided a ripple-effect removing valve between the pressure detecting device 3 and the mounting hole 14 of the hollow body 1 to eliminate the possibility of incorrect action of the diaphragm unit 32 due to the ripple-effect of the fluid.

SUMMARY OF THE INVENTION

The main object of the present invention is to provide a ripple-effect removing valve for use with a pressure detective device in a control assembly of a pump to ensure proper operation of an impeller unit of the pump.

Another object of the present invention is to provide a control assembly that incorporates a ripple-effect removing valve so as to control activation and deactivation of an impeller unit of a pump properly.

A further object of the present invention is to provide a rotary pressurizing pump having the aforementioned control assembly.

According to a first aspect of the present invention, a ripple-effect removing valve includes a casing having a lower inlet end, an upper outlet end and an interior fluid passage fluidly communicating the inlet and outlet ends. The fluid passage includes a generally upright lower section with a top opening, a generally upright upper section with a bottom opening, and a substantially horizontal intermediate section fluidly communicating the upper and lower sections. The ripple-effect removing valve further includes regulating means mounted on the casing for controlling fluid flow from the lower section to the upper section of the fluid passage.

According to a second aspect of the present invention, a control assembly is to be used with a pump which includes a hollow body having an inlet and an outlet that is formed in an upper portion of the hollow body, and a rotary impeller unit disposed in the hollow body for increasing pressure of fluid that flows from the inlet to the outlet. The control assembly includes a ripple-effect removing valve and a pressure detecting device.

The ripple-effect removing valve includes a casing having a lower inlet end adapted to be mounted on the upper portion of the hollow body of the pump while maintaining fluid communication therewith, an upper outlet end and an interior fluid passage fluidly communicating the inlet and outlet ends. The fluid passage includes a generally upright lower section with a top opening, a generally upright upper section with a bottom opening, and a substantially horizontal intermediate section fluidly communicating the upper and lower sections. The ripple-effect removing valve further includes regulating means mounted on the casing for controlling fluid flow from the lower section to the upper section of the fluid passage.

The pressure detecting device is mounted on the casing of the ripple-effect removing valve. The pressure detecting device includes a housing having a lower chamber fluidly communicated with the upper outlet end of the casing, a switch assembly disposed in the housing and adapted to be connected electrically to the impeller unit of the pump, a diaphragm unit disposed in the lower chamber, and an actuator mounted on the diaphragm unit and connected operably to the switch assembly. The actuator is urged by the diaphragm unit to control the switch assembly to deactivate the impeller unit when the pressure of the fluid entering the lower chamber via the fluid passage of the casing reaches a predetermined value.

According to a third aspect of the present invention, a rotary pressurizing pump includes a hollow body, a rotary impeller unit, a ripple-effect removing valve and a pressure detecting device.

The hollow body has an inlet and an outlet that is formed in an upper portion of the hollow body.

The rotary impeller unit is disposed in the hollow body for increasing pressure of fluid that flows from the inlet to the outlet.

The ripple-effect removing valve includes a casing having a lower inlet end mounted on the upper portion of the hollow body of the pump while maintaining fluid communication therewith, an upper outlet end and an interior fluid passage fluidly communicating the inlet and outlet ends. The fluid passage includes a generally upright lower section with a top opening, a generally upright upper section with a bottom opening, and a substantially horizontal intermediate section fluidly communicating the upper and lower sections. The ripple-effect removing valve further includes regulating means mounted on the casing for controlling fluid flow from the lower section to the upper section of the fluid passage.

The pressure detecting device is mounted on the casing of the ripple-effect removing valve. The pressure detecting device includes a housing having a lower chamber fluidly communicated with the upper outlet end of the casing, a switch assembly disposed in the housing and connected electrically to the impeller unit of the pump, a diaphragm unit disposed in the lower chamber, and an actuator mounted on the diaphragm unit and connected operably to the switch assembly. The actuator is urged by the diaphragm unit to control the switch assembly to deactivate the impeller unit when the pressure of the fluid entering the lower chamber via the fluid passage of the casing reaches a predetermined value.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
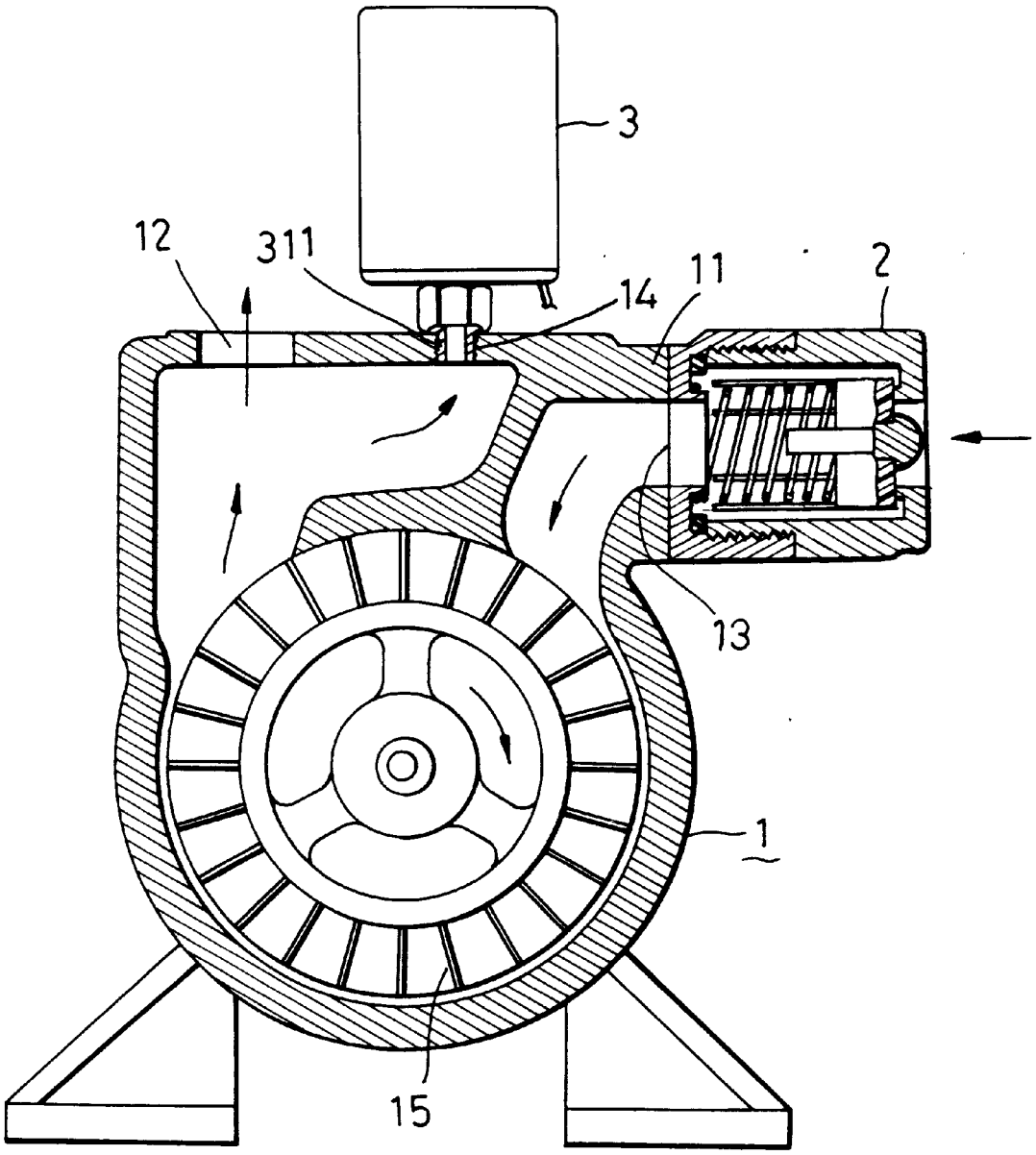
FIG.1 PRIOR ART
FIG. 1 is a schematic, partly sectional view of a conventional rotary pressurizing pump that incorporates a pressure detecting device.
Figure 2:
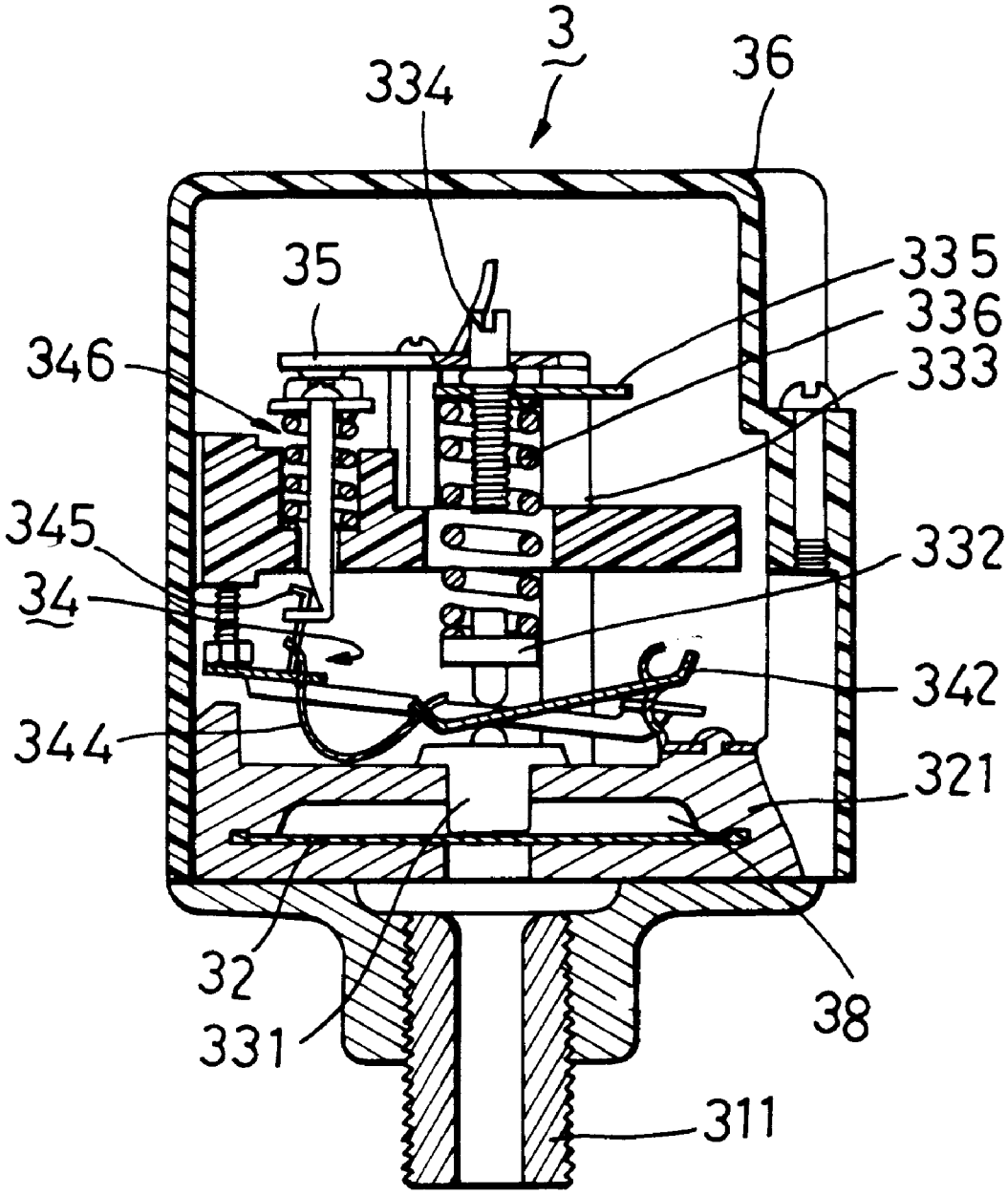
FIG. 2 PRIOR ART
FIG. 2 is a sectional view of the pressure detecting device in the conventional rotary pressuring pump of FIG. 1.
Figure 3:
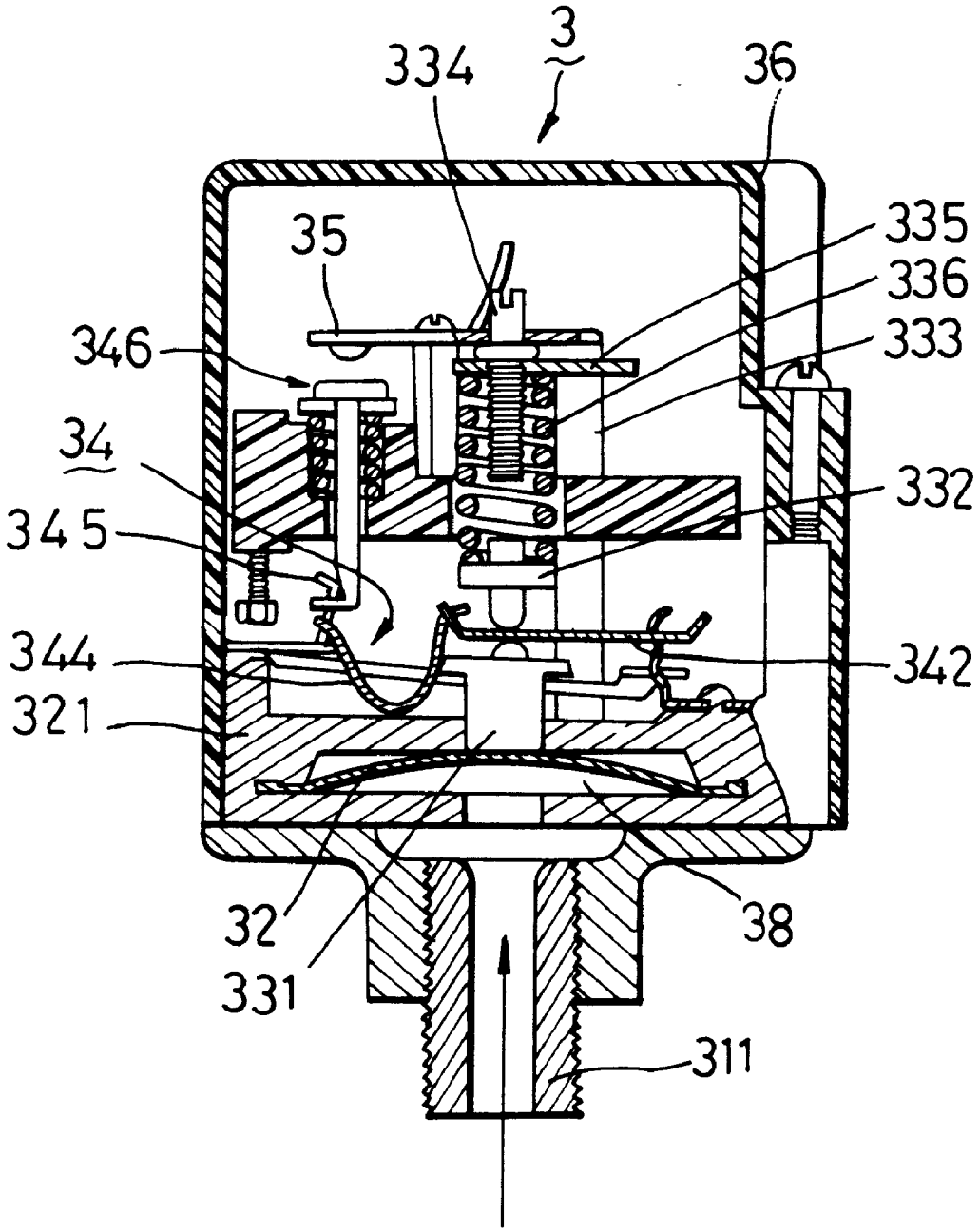
FIG.3 PRIOR ART
FIG. 3 illustrates the operation of the pressure detecting device of FIG. 2 when deactivating an impeller unit of the pump.

Before the present invention is described in greater detail, it should be noted that like elements are indicated by the same reference numerals throughout the disclosure.

Figure 4:
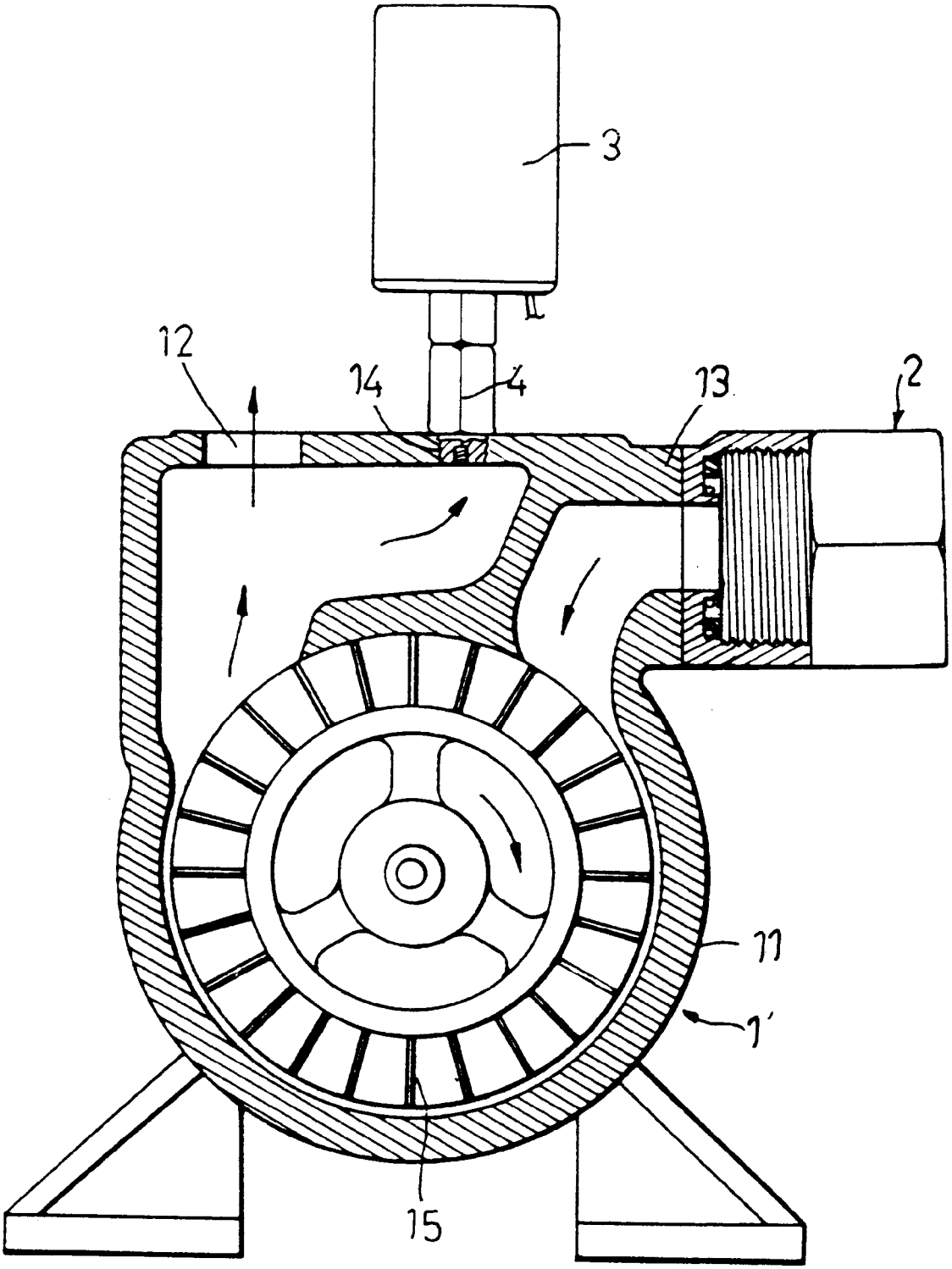
FIG. 4 illustrates a rotary pressurizing pump according to a preferred embodiment of the present invention.

Referring to FIG. 4, a rotary pressurizing pump 1' according to the preferred embodiment of the present invention includes a hollow body 11, a non-return valve 2 mounted on the hollow body 11, a rotary impeller unit 15 disposed in the hollow body 11, and a control assembly which includes a ripple-effect removing valve 4 and a pressure detecting device 3.

The hollow body 11, the non-return valve 2, the rotary impeller unit 15, and the pressure detecting device 3 are similar to those in the aforementioned conventional pressurizing pump 1 and will not be detailed further.

Figure 5:
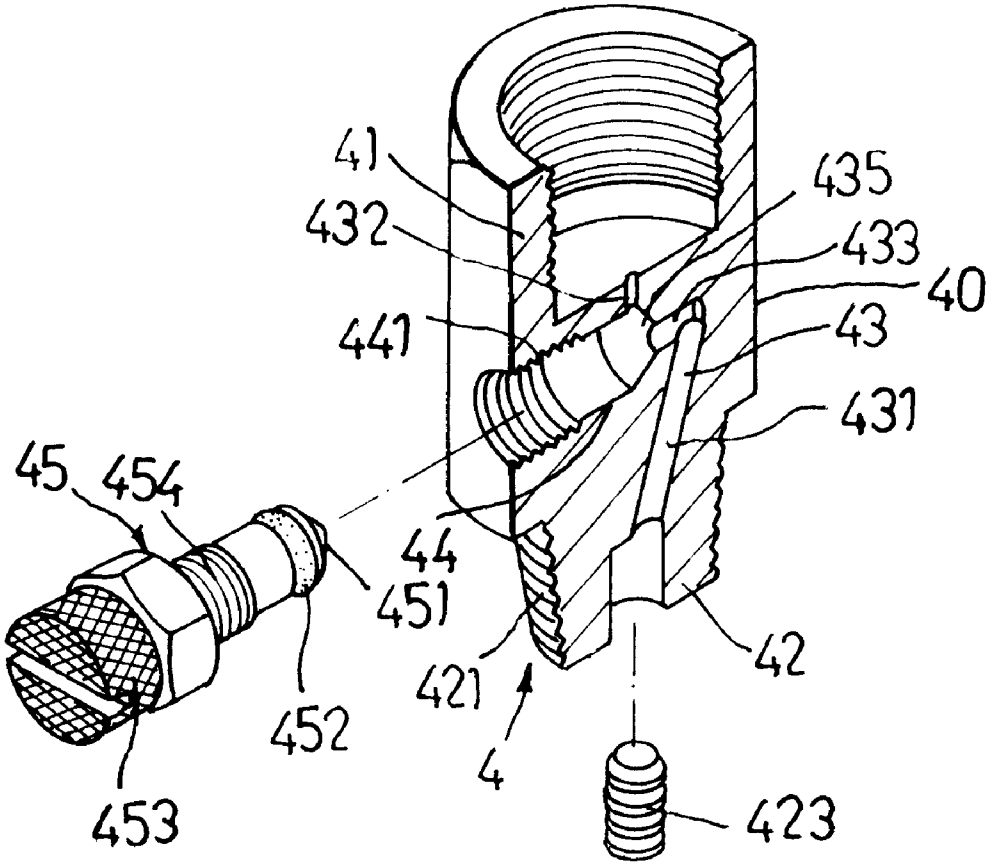
FIG. 5 illustrates a ripple effect removing valve used in the pressurizing pump of the preferred embodiment.
Figure 6:
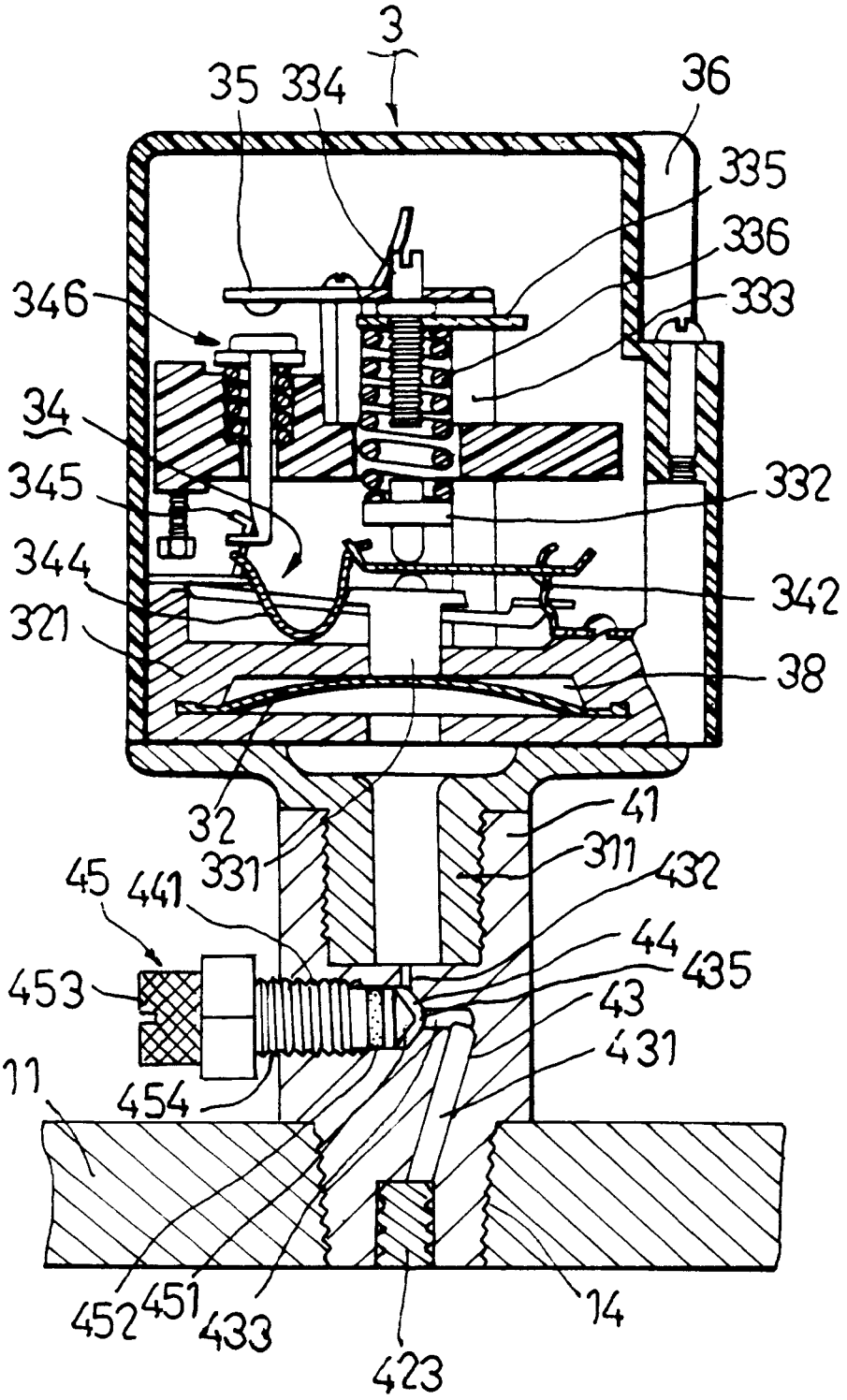
FIG. 6 illustrates a control assembly of the preferred embodiment.

Referring to FIGS. 5 and 6, the ripple-effect removing valve 4 includes a casing 40 having a lower inlet end 42 which is mounted in the mounting hole 14 formed in the upper portion of the hollow body 11 adjacent to the outlet 12, an upper outlet end 41, and an interior fluid passage 43 which fluidly communicates the inlet and outlet ends 42, 41. The lower inlet end 42 is in fluid communication with an interior of the hollow body 11 via the mounting hole 14. The lower inlet end 42 has a smooth inner surface and is provided with an externally threaded fluid guiding member 423 therein. The fluid guiding member 423 acts as a buffer to prevent instantaneous surge of fluid into the ripple-effect removing valve 4. The fluid passage 43 includes a generally upright lower section 431 with a top opening, a generally upright upper section 432 with a bottom opening, and a substantially horizontal intermediate section fluidly communicating the upper and lower sections 432, 431. The intermediate section includes a communicating hole portion 433 between the top opening of the lower section 431 and the bottom opening of the upper section 432, and a regulating hole portion 44 extending coaxially from the communicating hole portion 433. The regulating hole portion 44 has an internally threaded wall 441. The ripple-effect removing valve 4 further has regulating means which includes a regulating member 45 disposed movably in the regulating hole portion 44. The regulating member 45 is formed with an external screw thread 454 for engaging the internally threaded wall 441 of the regulating hole portion 44. The regulating member 45 has an operating portion 453 extending out of the regulating hole portion 44 to permit operation thereof, and a tapering end 451 extendible into the communicating hole portion 433. The communicating hole portion 433 has a tapering valve seat 435 formed therein to complement the tapering end 451 of the regulating member 45. Therefore, when the regulating member 45 is threaded inward into the regulating hole portion 44 so that the tapering end 451 is fitted in the tapering valve seat 435, fluid flow in the fluid passage 43 can be entirely obstructed. In this manner, the fluid flow in the fluid passage 43 can be controlled by merely threading the regulating member 45 inward and outward. The regulating member 45 is provided with a sealing ring 452 adjacent to the tapering end 451 to prevent leakage of fluid via the regulating hole portion 44. It is noted that, even though the tapering end 451 does not extend to the communicating hole portion 433 to avoid blocking of the fluid passage 43, the ripple-effect of the fluid can be substantially eliminated with the mere provision of the generally upright lower and upper sections 431, 432 and the substantially horizontal communicating hole portion 433.

As shown in FIG. 6, the pressure detecting device 3 is mounted on the upper outlet end 41 of the ripple-effect removing valve 4 with the lower chamber 38 thereof being in fluid communication with the upper outlet end 41. In this manner, the diaphragm unit 32 senses the pressure of the fluid entering the lower chamber 38 via the fluid passage 43 of the ripple-effect removing valve 4. Incorrect action of the diaphragm unit 32 caused by the ripple-effect of the fluid can thus be eliminated. Therefore, the impeller unit 15 of the pump 1' can be deactivated correctly upon detecting that the pressure of fluid reaches a predetermined value.

With this invention thus explained, it is apparent that numerous modifications and variations can be made without departing from the scope and spirit of this invention. It is therefore intended that this invention be limited only as indicated in the appended claims.

We claim:

1. A control assembly for a pump which includes a hollow body having an inlet and an outlet that is formed in an upper portion of the hollow body, and a rotary impeller unit disposed in the hollow body for increasing pressure of fluid that flows from the inlet to the outlet, said control assembly comprising:

a ripple-effect removing valve including:

a casing having a lower inlet end adapted to be mounted on the upper portion of the hollow body of the pump while maintaining fluid communication therewith, an upper outlet end and an interior fluid passage fluidly communicating said inlet and outlet ends, said fluid passage including a generally upright lower section with a top opening, a generally upright upper section with a bottom opening, and a substantially horizontal intermediate section fluidly communicating said upper and lower sections; and regulating means mounted on said casing for controlling fluid flow from said lower section to said upper section of said fluid passage; and a pressure detecting device mounted on said casing of said ripple-effect removing valve, said pressure detecting device including a housing having a lower chamber fluidly communicated with said upper outlet end of said casing, a switch assembly disposed in said housing and adapted to be connected electrically to the impeller unit of the pump, a diaphragm unit disposed in said lower chamber, and an actuator mounted on said diaphragm unit and connected operably to said switch assembly, said actuator being urged by said diaphragm unit to control said switch assembly to deactivate the impeller unit when the pressure of the fluid entering said lower chamber via said fluid passage of said casing reaches a predetermined value.

2. The control assembly according to claim 1, wherein said pressure detecting device further comprises a biasing spring with a presettable spring force for pushing said diaphragm unit to resist bulging thereof until the pressure of the fluid reaches the predetermined value.

3. The control assembly according to claim 1, wherein said intermediate section of said fluid passage of said casing of said ripple-effect removing valve includes a communicating hole portion between said top opening of said lower section and said bottom opening of said upper section, and a regulating hole portion extending coaxially from said communicating hole portion, said regulating means of said ripple-effect removing valve including a regulating member which is disposed movably in said regulating hole portion and which is extendible into said communicating hole portion for controlling fluid flow from said lower section to said upper section of said fluid passage.

4. The control assembly according to claim 3, wherein said regulating hole portion has an internally threaded wall, said regulating member being formed with an external screw thread for engaging said internally threaded wall.

5. The control assembly according to claim 3, wherein said regulating member has a tapering end extendible into said communicating hole portion of said intermediate section of said fluid passage, said communicating hole portion having a tapering valve seat formed therein to complement said tapering end of said regulating member.

6. A rotary pressurizing pump comprising:

a hollow body having an inlet and an outlet that is formed in an upper portion of said hollow body;

a rotary impeller unit disposed in said hollow body for increasing pressure of fluid that flows from said inlet to said outlet;

a ripple-effect removing valve including:

a casing having a lower inlet end mounted on said outlet of said hollow body while maintaining fluid communication therewith, an upper outlet end and an interior fluid passage fluidly communicating said inlet and outlet ends, said fluid passage including a generally upright lower section with a top opening, a generally upright upper section with a bottom opening, and a substantially horizontal intermediate section fluidly communicating said upper and lower sections; and regulating means mounted on said casing for controlling fluid flow from said lower section to said upper section of said fluid passage; and a pressure detecting device mounted on said casing of said ripple-effect removing valve, said pressure detecting device including a housing having a lower chamber fluidly communicated with said upper outlet end of said casing, a switch assembly disposed in said housing and connected electrically to said impeller unit, a diaphragm unit disposed in said lower chamber, and an actuator mounted on said diaphragm unit and connected operably to said switch assembly, said actuator being urged by said diaphragm unit to control said switch assembly to deactivate said impeller unit when the pressure of the fluid entering said lower chamber via said fluid passage of said casing reaches a predetermined value.

7. The rotary pressurizing pump according to claim 6, wherein said pressure detecting device further comprises a biasing spring with a presettable spring force for pushing said diaphragm unit to resist bulging thereof until the pressure of the fluid reaches the predetermined value.

8. The rotary pressurizing pump according to claim 6, wherein said intermediate section of said fluid passage of said casing of said ripple-effect removing valve includes a communicating hole portion between said top opening of said lower section and said bottom opening of said upper section, and a regulating hole portion extending coaxially from said communicating hole portion, said regulating means of said ripple-effect removing valve including a regulating member which is disposed movably in said regulating hole portion and which is extendible into said communicating hole portion for controlling fluid flow from said lower section to said upper section of said fluid passage.

9. The rotary pressurizing pump according to claim 8, wherein said regulating hole portion has an internally threaded wall, said regulating member being formed with an external screw thread for engaging said internally threaded wall.

10. The rotary pressurizing pump according to claim 8, wherein said regulating member has a tapering end extendible into said communicating hole portion of said intermediate section of said fluid passage, said communicating hole portion having a tapering valve seat formed therein to complement said tapering end of said regulating member.

* * * * *